US009232619B2

(12) United States Patent
Chou et al.

(10) Patent No.: US 9,232,619 B2
(45) Date of Patent: Jan. 5, 2016

(54) FLUORESCENT ELECTRONIC BALLAST

(71) Applicant: DELTA ELECTRONICS, INC., Taoyuan Hsien (TW)

(72) Inventors: Ching-Ho Chou, Taoyuan Hsien (TW); Yung-Chuan Lu, Taoyuan Hsien (TW); Yen-Yu Chen, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 0 days.

(21) Appl. No.: 14/290,669

(22) Filed: May 29, 2014

(65) Prior Publication Data

US 2015/0195889 A1 Jul. 9, 2015

(30) Foreign Application Priority Data

Jan. 3, 2014 (TW) ..... 103100143 A

(51) Int. Cl.
*H05B 37/02* (2006.01)
*H05B 41/282* (2006.01)

(52) U.S. Cl.
CPC ..... *H05B 41/2828* (2013.01); *H05B 37/02* (2013.01)

(58) Field of Classification Search
CPC ..... H05B 37/02
USPC ..... 315/224, 247, 294, 307, 308
See application file for complete search history.

(56) References Cited

U.S. PATENT DOCUMENTS 5,869,935 A * 2/1999 Sodhi ..... H05B 41/2855 315/127
8,339,056 B1 * 12/2012 Xiong ..... H05B 41/2828 315/224
2007/0296355 A1 * 12/2007 Hamamoto et al. ..... 315/309
2014/0049159 A1 * 2/2014 Kumar et al. ..... 315/34
2014/0111089 A1 * 4/2014 Guleria et al. ..... 315/121

FOREIGN PATENT DOCUMENTS

TW 200526085 8/2005

OTHER PUBLICATIONS

Office action from corresponding Taiwanese application No. 103100143, mailed Aug. 18, 2015, 4 pages.

* cited by examiner

*Primary Examiner* — Tung X Le
(74) *Attorney, Agent, or Firm* — Muncy, Geissler, Olds & Lowe, P.C.

(57) ABSTRACT

A fluorescent electronic ballast including: a rectifier circuit, for receiving an AC power supply and converting the AC power supply into a DC power supply; an inverter circuit, coupled to a fluorescent driver circuit, for converting the DC power supply into a high-frequency AC power supply for driving a fluorescent; and a detection protection circuit, coupled to the rectifier circuit and the inverter circuit, for detecting the DC power supply provided by the rectifier circuit, and cutting off the electric connection between a control chip of the inverter circuit and all of power supply when the voltage of the direct current power supply is lower than a predetermined value, wherein the power supply at least includes the direct current power supply provided by the rectifier circuit.

6 Claims, 4 Drawing Sheets

FLUORESCENT ELECTRONIC BALLAST

CROSS REFERENCE TO RELATED APPLICATIONS

This Non-provisional application claims priority under 35 U.S.C. §119(a) on Patent Application No(s). 103,100,143, filed in Taiwan, Republic of China on Jan. 3, 2014, the entire contents of which are hereby incorporated by reference.

BACKGROUND OF THE INVENTION

1. Field of the Invention

The present invention relates to a detection protection technology for fluorescent electronic ballasts.

2. Description of the Related Art

Fluorescent lamps have excellent power saving features, and have gradually become the mainstream lamps, replacing the traditional incandescent lamp. There is a difference between the fluorescent lamp and the incandescent lamp, which is that the fluorescent lamp has to be used with electronic ballast for producing high voltage for ionizing gas in the lamp.

FIG. 1 is a schematic diagram of an electronic ballast 100 of the prior art. As shown in FIG. 1, the electronic ballast 100 is coupled to the fluorescent 110, and comprises: a filter circuit 102, a rectifier circuit 104, a power factor correction circuit 106 and an inverter circuit 108. The filter circuit 102 can filter out high frequency noise from an alternating current power supply. The rectifier circuit 104 can convert the alternating current power supply into a direct current power supply. The power factor correction circuit 106 can increase power factor and reduce harmonics. The inverter circuit 108 can produce the high-frequency alternative power supply for the fluorescent. Note that when the power supply is turned off and its voltage drops, the high voltage electrolytic capacitors in the power factor correction circuit 106 still keep providing power to the inverter circuit 108 and the fluorescent 110. As such, the inverter circuit 108 will become an inductive load rather a capacitive load (see the relationship between the voltage and the current of the inverter circuit 108 as shown in FIG. 2), thus increasing the possibility of breaking down the power semiconductor switching units and the control chip of the inverter circuit 108.

Therefore, the present invention provides a new fluorescent electronic ballast, which can prevent damaging power semiconductor switching units and control chip in an inverter circuit of the electronic ballast, thus prolonging the lifetime of the fluorescent lamp.

BRIEF SUMMARY OF THE INVENTION

The present invention provides a fluorescent electronic ballast. The fluorescent electronic ballast has: a rectifier circuit, for receiving an alternating current (AC) power supply and converting the alternating current into a direct current (DC) power supply; an inverter circuit, coupled to a fluorescent driver circuit, for converting the direct current power supply into a high-frequency alternating current power supply for driving a fluorescent; and a detection protection circuit, coupled to the rectifier circuit and the inverter circuit, for detecting the direct current power supply provided by the rectifier circuit, and cutting off the electric connection between a control chip of the inverter circuit and all of power supply when the voltage of the direct current power supply is lower than a predetermined value, wherein the power supply at least comprises the direct current power supply provided by the rectifier circuit.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
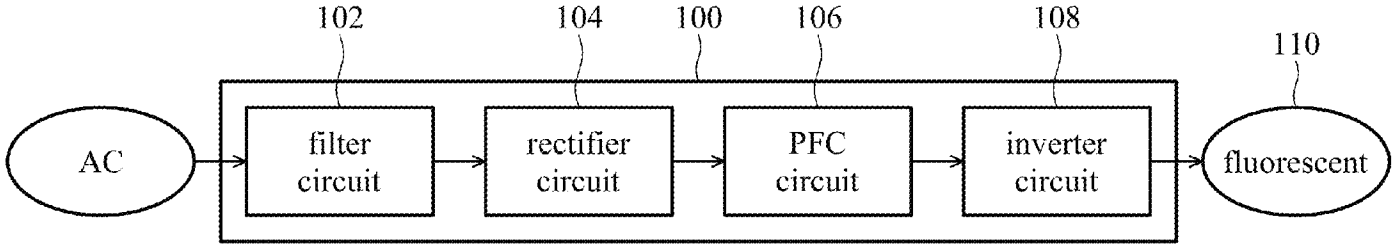
FIG. 1 (Prior Art)
FIG. 1 is a schematic diagram of an electronic ballast 100 of the prior art.
Figure 2:
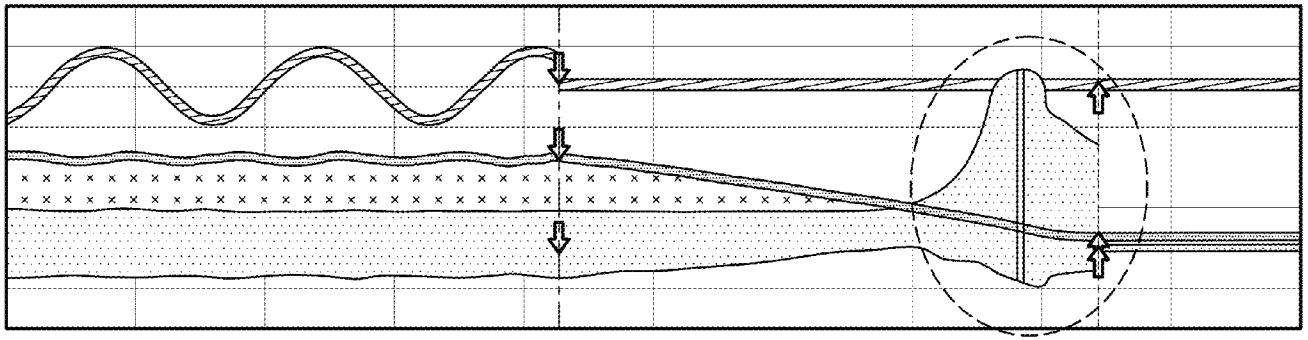
FIG. 2 (Prior Art)
FIG. 2 is a plot of the relationship between voltage and current on the inverter circuit.
Figure 3A:
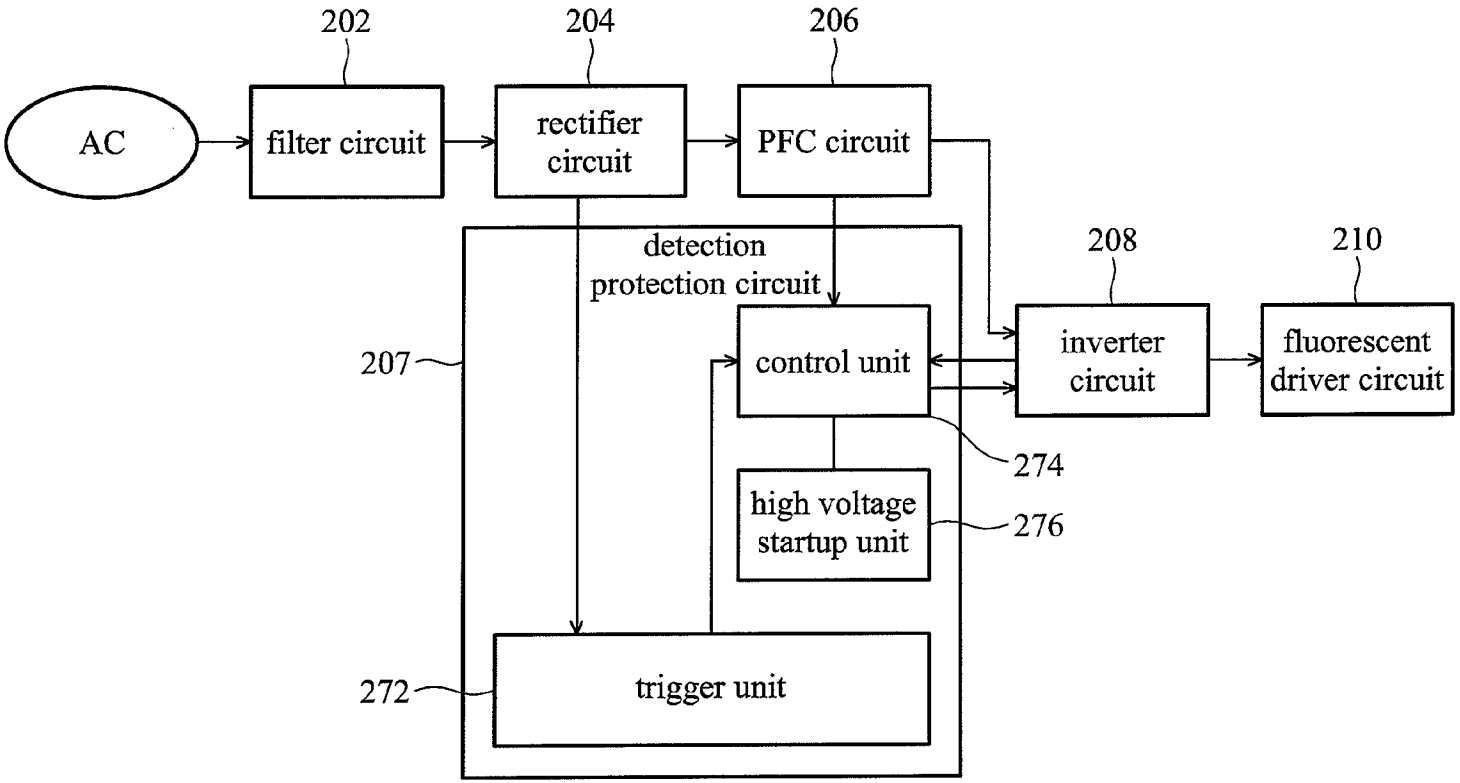
FIG. 3A is a schematic diagram of the fluorescent electronic ballast of the present invention.
Figure 3B:
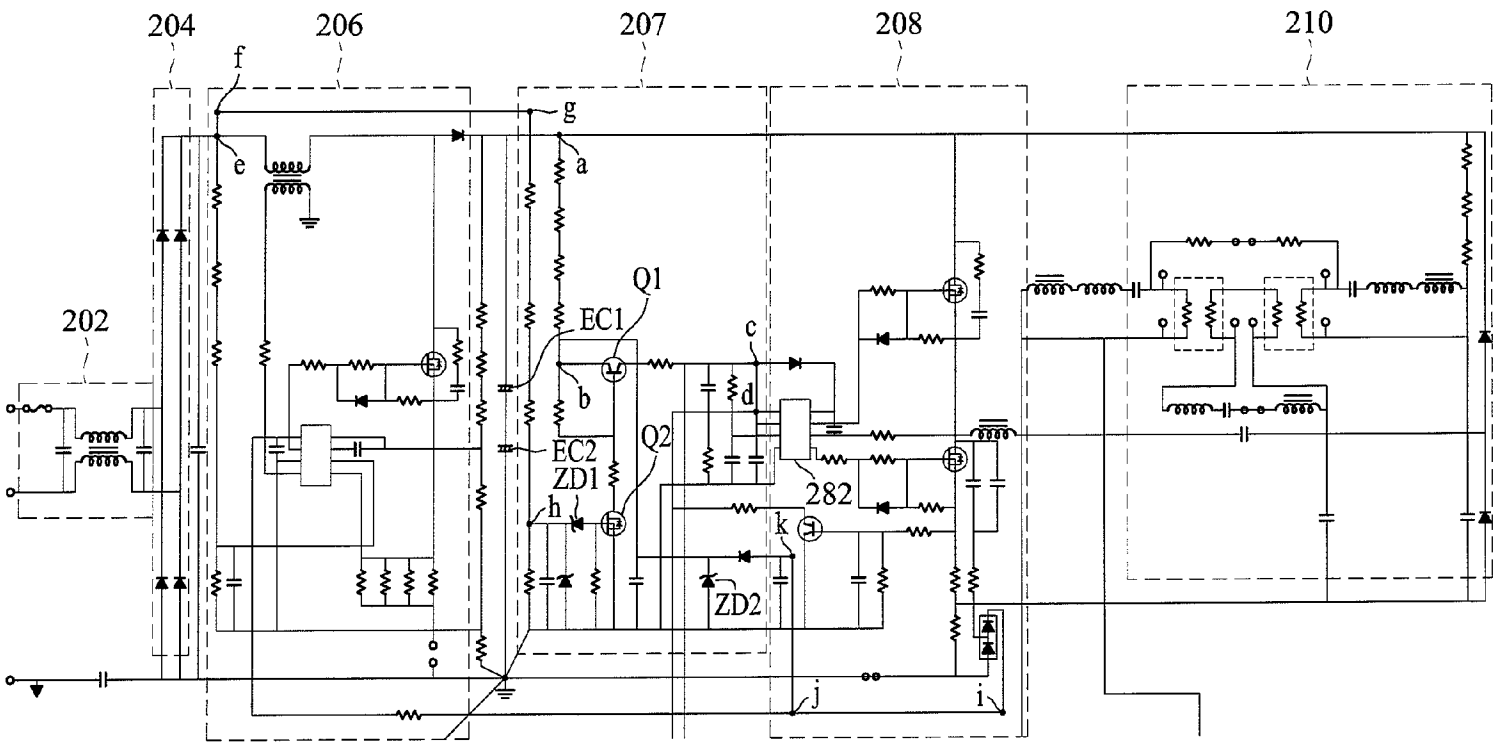
FIG. 3B is the circuit diagram of the fluorescent electronic ballast according to an embodiment of the present invention.

FIG. 3A is a schematic diagram of the fluorescent electronic ballast of the present invention. FIG. 3B is the circuit diagram of the fluorescent electronic ballast according to an embodiment of the present invention. Refer to FIG. 3A and FIG. 3B, the fluorescent electronic ballast of the present invention comprises: a filter circuit 202, a rectifier circuit 204, a power factor correction (PFC) circuit 206, a detection protection circuit 207, an inverter circuit 208, and a fluorescent driver circuit 210. The filter circuit 202 of the present invention is used for filtering out high frequency noise from the alternative current power supply. The rectifier circuit 204 of the present invention is coupled to the filter circuit 202, and is used to convert the alternating current power supply into the direct current. Part of the direct current power supply will flow through the power factor correction circuit 206 and be converted into high frequency alternating current power supply that the fluorescent driver circuit 210 requires by the inverter circuit 208, while the other part of the direct current power supply will be provided to the control chip of the inverter circuit 208 (control chip 282 in FIG. 3B). The power factor correction circuit 206 is coupled to the rectifier circuit 204, and is used to increase the power factor of the fluorescent electronic ballast 200. Note that the power factor correction circuit 206 of the present invention has the same high-voltage electrolytic capacitors (i.e., capacitors EC1 and EC2 in FIG. 3B). Therefore, the main feature of the present invention is to add a detection protection circuit 207, which can cut off the direct current power supply of the control chip of the inverter circuit immediately when the alternating current power supply provided by the mains supply is cut off, thus halting the inverter circuit 208 and preventing the inverter circuit 208 from becoming a capacitive load. The detection protection circuit 207 of the present invention will be further discussed in detail in accordance with FIGS. 2 and 4.

Figure 4:
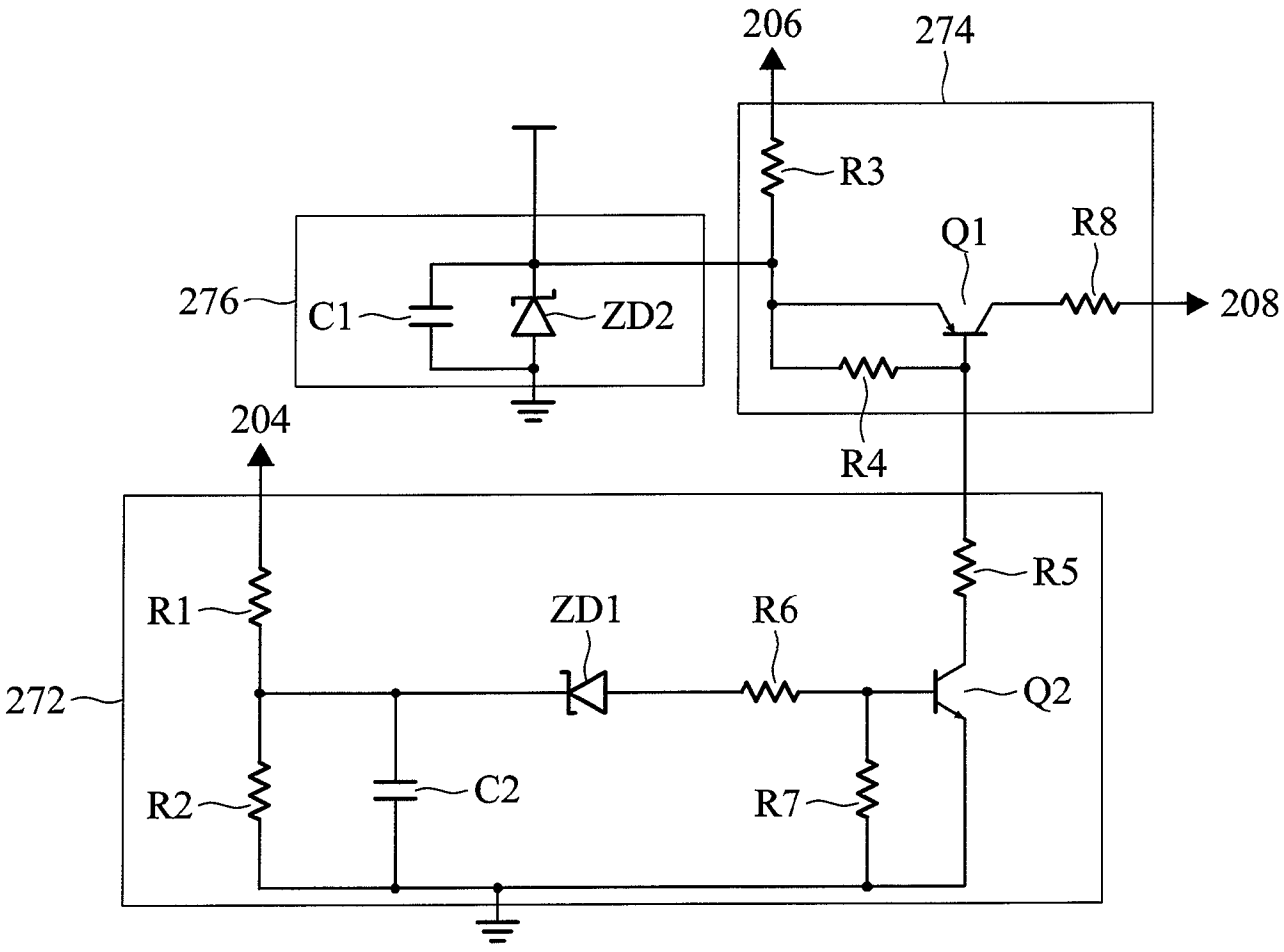
FIG. 4 is a circuit diagram of the detection protection circuit 207 according to an embodiment of the present invention.

FIG. 4 is a circuit diagram of the detection protection circuit 207 according to an embodiment of the present invention. As shown in FIGS. 3A and 4, the detection protection circuit 207 is coupled among the rectifier circuit 204, the power factor correction circuit 206 and the inverter circuit 208. The detection protection circuit 207 is used to detect the direct current power supply provided by the rectifier circuit 204, and cut off the electric connection between the control chip 282 of the inverter circuit 208 and all the power supply when the rectifier circuit 204 stops providing the direct current. Specifically, when detecting the direct current power supply that is output by the rectifier circuit 204 is lower than a predetermined value, the detection protection circuit 207 determines that the direct current power supply will stop, and thus cuts off the power supply for the control chip 282 of the inverter circuit 208. This manner prevents the inverter circuit 208 from continuous operation and becoming a capacitive load, which may produce a pulse current and damage the power semiconductor switching elements and the control chip in the inverter circuit 208.

The detection protection circuit 207 of the present invention at least comprises a trigger unit 272 and a control unit 274. In the embodiment of FIG. 4, the control unit 274 is mainly constituted by a first transistor Q1. The first transistor Q1 has an emitter coupled to the power source via a resistor R3, and a collector coupled to a power supply terminal of the control chip 282 of the inverter circuit 208 via a resistor R8. Therefore, the first transistor Q1 can control the electrical connection among these components. As shown in FIG. 3B, when the power is turned on, the trigger unit 272 turns on the first transistor Q1, and the power from the rectifier circuit 204 is provided to the power supply terminal of the control chip 282 of the inverter circuit 208 via a "startup path" formed by nodes a, b, c and d. Then, when the inverter circuit 208 starts up, the direct current power supply for the control chip 282 will be provided by a "feedback path" which is formed by nodes i, j, k, b, c and d. Note that the control unit 274 will be controlled by the trigger unit 272, which will be discussed below.

In the embodiment of FIG. 4, the trigger unit 272 is mainly constituted by a second transistor Q2 and a Zener diode ZD1. The collector of the second transistor Q2 is coupled to the base of the first transistor Q1 of the control unit 274 via the resistor R5. Therefore, the first transistor Q1 can be turned on or off as the second transistor Q2 is turned on or off. In the embodiment of FIG. 4, the negative terminal of the Zener diode ZD1 is coupled to the rectifier circuit 204 via a dividing circuit which is composed of the resistors R1 and R2, and the positive terminal of the Zener diode ZD1 is coupled to the base of the second transistor Q2 via another dividing circuit which is composed of the resistors R6 and R7. In a preferred embodiment, a ground capacitor C2 is coupled to the resistor R2 in parallel. With a proper design of the resistor R1 and R2, the voltage on the negative terminal of the Zener diode ZD1 can reach a breakdown level when the rectifier circuit 204 normally provides the direct current power supply. Then, the second transistor Q2 and the first transistor Q1 are turned on, so that the control chip 282 can receive the startup power. And, after the control chip starts up, the control chip 282 can receive the direct current power supply which is feedback from the inverter circuit 208 through the "feedback path", and provide the direct current power supply to the control chip 282 of the inverter circuit 208 via the first transistor Q1, thus turning on the inverter circuit 208. However, when the alternating current power supply is cut off, the rectifier circuit 204 will stop providing the direct current power supply (i.e., its voltage level is lower than a predetermined value). And, the Zener diode ZD1 is triggered by the rectifier circuit 204 and turned off, so that the second transistor Q2 and the first transistor Q1 are turned off, thus cutting off the electric connection between the control chip 282 of the inverter circuit 208 and all of the power supply (including the startup power provided by the rectifier circuit 204 through the "startup path", and the direct current power supply provided by the inverter circuit 208 through the "feedback path"). As shown in FIG. 3B, when the power supply is in a normal state, the rectifier circuit 204 provides the current to the second transistor Q2 through the path formed by nodes e, f, g and h. However, when the rectifier circuit 204 stops outputting the current, the voltage on the node h drops rapidly so that the Zener diode ZD1 is turned off, and then the second transistor Q2 and the first transistor Q1 are turned off, thus cutting off the startup power from the "startup path" (formed by nodes a, b, c and d) and the direct current power supply from the "feedback path" (formed by nodes i, j, k, b, c, d). In this manner, the control chip 282 can be properly shut down when the power supply is turned off, thus preventing the inverter circuit 208 from becoming a capacitive load from an inductive load and damaging the power semiconductor switching units and the control chip. The present invention can prolong the life time of the fluorescent electronic ballast.

In a preferred embodiment, as shown in FIG. 4, the detection protection circuit 207 of the present invention further comprises a high-voltage startup unit 276. The high-voltage startup unit 276 is coupled to the control unit 274 in the detection protection circuit 207 (in this preferred embodiment, coupled to the node b in FIG. 3*b*). In the embodiment of FIG. 4, the high-voltage startup unit 276 comprises a second Zener diode ZD2 and a capacitor C1. The second Zener diode ZD2 has a positive terminal coupled to the ground, and a negative terminal coupled to the direct current power supply feedback by the inverter circuit 208 (via the "feedback path" which is formed by nodes i, j and k). Thus, there is a voltage level on the output terminal of the first transistor Q1 (i.e., node b). In addition, the capacitor C1 is connected to the second Zener diode ZD2 in parallel. With the second Zener diode ZD2 of the high-voltage startup unit 276, the present invention can limit the input voltage of the first transistor Q1 under a specific voltage level. Therefore, the first transistor Q1 can be a low-pressure component, and the manufacturing cost of the entire circuit can be further reduced.

Note that, for illustration, the first and the second transistors Q1 and Q2 in the embodiments are bipolar junction transistors (BJTs), however those skilled in the art will understand that the type of transistor should not be limited thereto. For example, the first and second transistors Q1 and Q2 can be metal-oxide-semiconductor field-effect transistors (MOSFETs). In order for the overall electrical characteristics of the fluorescent electronic ballast to meet the requirements of various applications, those skilled in the art can properly design the values of the resistance and capacitance, and modify the circuit arrangement in the aforementioned embodiments based on the principle of the present invention.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fluorescent electronic ballast, comprising:

a rectifier circuit, for receiving an alternating current (AC) and converting the alternating current into a direct current (DC) power supply;

an inverter circuit, coupled to a fluorescent driver circuit, for converting the direct current power supply into a high-frequency alternating current power supply for driving a fluorescent; and a detection protection circuit, coupled to the rectifier circuit and the inverter circuit, for detecting the direct current power supply provided by the rectifier circuit, and determining whether cutting off the electric connection between a control chip of the inverter circuit and all of power supply when a voltage of the direct current power supply is lower than a predetermined value, wherein the power supply at least comprises the direct current power supply provided by the rectifier circuit, wherein the detection protection circuit comprises:

a control unit, comprising a first transistor, coupled to a power supply terminal of the control chip of the inverter circuit; and a trigger unit, further comprising:

a second transistor, coupled to the first transistor, wherein the first transistor is cut off as the second transistor is cut off; and a first Zener diode, having a negative terminal coupled to an output terminal of the rectifier circuit; and a positive terminal coupled to the second transistor, wherein when the voltage of the direct current power supply is lower than the predetermined value, the second transistor is cut off and the first transistor is cut off.

2. The fluorescent electronic ballast as claimed in claim 1, wherein the power supply cut by the detection protection circuit when the voltage of the direct current power supply is lower than the predetermined value further comprises a direct current power supply which is fed back to the control chip from the inverter circuit.

3. The fluorescent electronic ballast as claimed in claim 1, wherein the detection protection circuit further comprises:

a high-voltage startup unit, coupled to the control unit of the detection protection circuit, for limiting an input voltage of the first transistor under a specific voltage level.

4. The fluorescent electronic ballast as claimed in claim 3, wherein the high-voltage startup unit further comprises:

a second Zener diode, having a negative terminal coupled to the direct current power supply feedback from the inverter circuit, and a positive terminal coupled to a ground; and a capacitor, connected to the second Zener diode in parallel.

5. The fluorescent electronic ballast as claimed in claim 1, further comprising: a power factor correction circuit, coupled to the rectifier circuit, for increasing power factor of the fluorescent electronic ballast.

6. The fluorescent electronic ballast as claimed in claim 1, further comprising: a filter circuit, coupled between the rectifier circuit and a mains supply, wherein the mains supply provides the alternating current power supply, and the filter circuit is used for filtering out the high-frequency noise from the alternating current power supply.

* * * * *